US012429303B2

(12) United States Patent
Shearer

(10) Patent No.: US 12,429,303 B2
(45) Date of Patent: Sep. 30, 2025

(54) DUAL PIVOT DROP THIGH MOUNT

(71) Applicant: Tedder Industries, LLC, Post Falls, ID (US)

(72) Inventor: Jacob Shearer, Moses Lake, WA (US)

(73) Assignee: Tedder Industries LLC, Post Falls, ID (US)

( * ) Notice: Subject to any disclaimer, the term of this patent is extended or adjusted under 35 U.S.C. 154(b) by 177 days.

(21) Appl. No.: 18/483,029

(22) Filed: Oct. 9, 2023

(65) Prior Publication Data

US 2024/0118055 A1 Apr. 11, 2024

Related U.S. Application Data

(60) Provisional application No. 63/414,715, filed on Oct. 10, 2022.

(51) Int. Cl.
*F41C 33/04* (2006.01)

(52) U.S. Cl.
CPC ..... *F41C 33/046* (2013.01); *F41C 33/041* (2013.01)

(58) Field of Classification Search
CPC ..... F41C 33/041; F41C 33/046
USPC ..... 224/661
See application file for complete search history.

(56) References Cited

U.S. PATENT DOCUMENTS 4,029,242 A * 6/1977 Stoesser ..... F41C 33/046 224/222
4,953,767 A * 9/1990 Bennett ..... F41C 33/046 224/267
6,149,042 A * 11/2000 Rassias ..... F41C 33/0236 224/907
6,547,118 B2 * 4/2003 Beletsky ..... A45F 5/00 224/684
6,685,066 B2 * 2/2004 Cragg ..... F41C 33/0218 224/198
6,755,331 B2 * 6/2004 Rassias ..... F41C 33/0227 42/70.11
7,950,554 B2 * 5/2011 Hoffner ..... A45F 5/021 224/661
8,196,792 B2 * 6/2012 Clifton, Jr. ..... F41C 33/041 224/678
D690,504 S * 10/2013 Tyybakinoja ..... D3/222
9,222,751 B2 * 12/2015 Glock ..... F41C 33/045
11,378,356 B2 * 7/2022 Treto ..... F41C 33/04
2008/0061098 A1 * 3/2008 Hoffner ..... F41C 33/046 224/661
2014/0124557 A1 * 5/2014 Velarde ..... A61F 5/0123 224/576
2015/0108191 A1 * 4/2015 Velarde ..... F41C 33/048 224/576
2021/0215456 A1 * 7/2021 Treto ..... F41C 33/04
2023/0371957 A1 * 11/2023 Watts ..... G06F 17/12
2024/0118054 A1 * 4/2024 Shearer ..... F41C 33/041

* cited by examiner

*Primary Examiner* — Justin M Larson
(74) *Attorney, Agent, or Firm* — Chang and Hale LLP

(57) ABSTRACT

A drop thigh mount assembly is used to mount and to support an implement (such as a handgun, for example) or an implement holster (such as a handgun holster, for example), or the like (e.g., various pouches, holders, accessories, etc.), in a variety of configurations. A mounting plate of the drop thigh mount is configured to be worn at a user's thigh and the mount includes at least two pivot points for articulation.

20 Claims, 7 Drawing Sheets

DUAL PIVOT DROP THIGH MOUNT

PRIORITY CLAIM AND CROSS-REFERENCE TO RELATED APPLICATION

This application claims the benefit under 35 U.S.C. § 119(e)(1) of U.S. Provisional Application No. 63/414,715, filed Oct. 10, 2022, which is hereby incorporated by reference in its entirety.

BACKGROUND

Implements, such as tools, weapons, and the like, may be encased in a holster for protection of the implement and/or the user, while providing access to the implement. For example, a holster may allow a user to conveniently carry the implement, safely retaining the implement until needed. When the implement is to be used, the user may withdraw the implement from the holster, and then return it to the holster when finished. In some cases, such as with a handgun for example, the holster may allow the user to conceal the implement, or to conceal the fact that the user is carrying the implement.

In the case of a handgun, the holster should reasonably protect the handgun and the user, and should be convenient to the user for ready use. However, the holster should also be versatile enough to be comfortably carried by the user, such as when it is worn on the person of the user for an extended length of time. The holster should also be rigid and stable enough to allow the handgun to be repeatedly drawn and re-holstered, usually with the same hand.

At times it can be desirable to carry an implement such as a handgun in various locations on the user, for instance on a leg or thigh of the user. However, when doing so, it is desirable that the holster or holster mount provides versatility in accessing the handgun, as well as a high level of protection to the user and also to the handgun. It can also be desirable for the holster or holster mount to be securely attached to the user, particularly in military or law enforcement applications, or the like, such as where the user may be engaged in running, jumping, climbing, or other physical activities.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Figure 1:
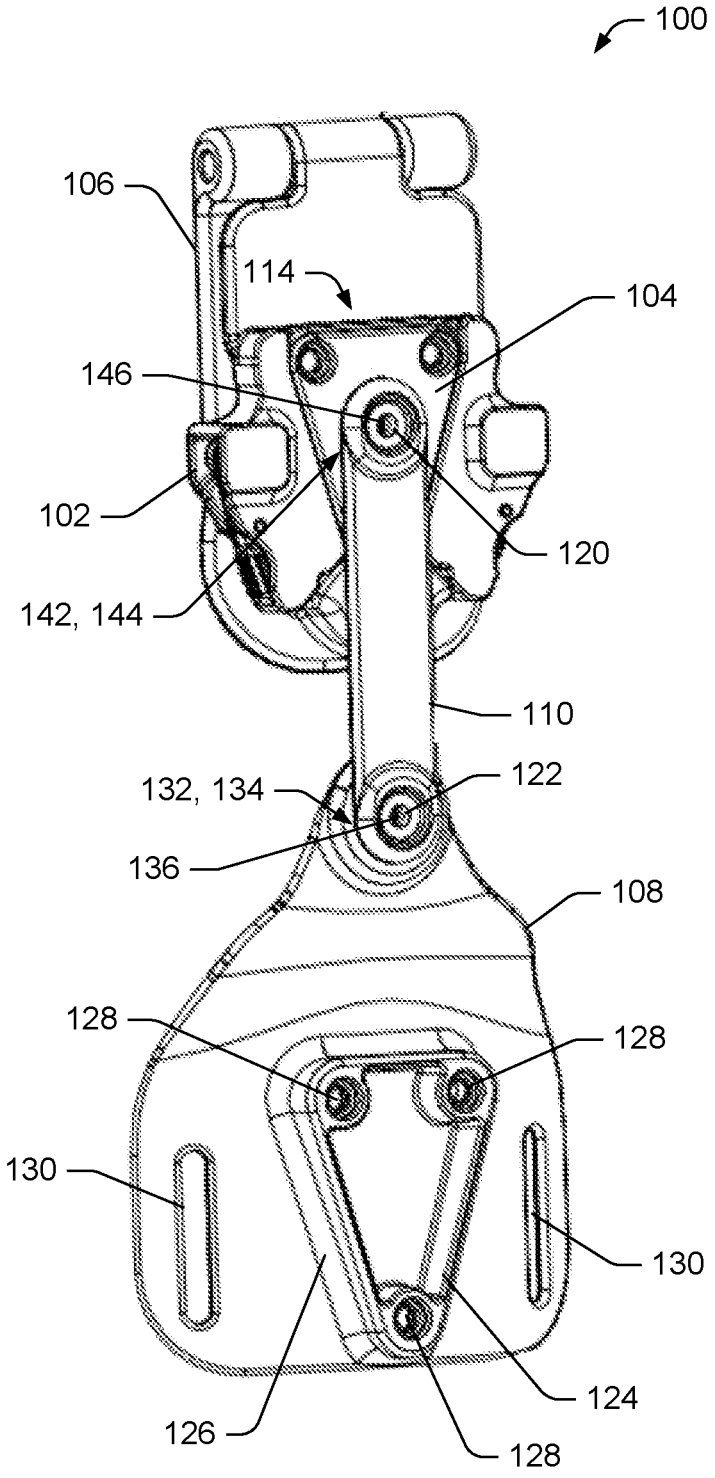
FIG. 1 shows a perspective view of an example dual pivot drop thigh mount assembly, according to an embodiment.

Representative implementations of devices and techniques provide a dual pivot drop thigh mount assembly, to mount and to support an implement (such as a handgun, for example), an implement holster (such as a handgun holster or shell, for example), or the like, in a variety of configurations. Alternately or additionally, the dual pivot drop thigh mount assembly may be used to support one or more accessories (such as mag carriers, tourniquet carriers, flashlight carriers, etc.) as desired. The implement, implement holster, and/or accessories are intended to be removable from the dual pivot drop thigh mount assembly when desired by the user, but are intended to remain securely attached to the dual pivot drop thigh mount assembly until intentionally removed.

The dual pivot drop thigh mount assembly is arranged to be worn on a user's person, such as on the user's upper leg (for example) for temporarily and safely carrying the implement and/or accessories, while making the implement and/or accessories easily accessible to the user. In various examples, the dual pivot drop thigh mount assembly can be coupled to the user's clothing or gear for securing the dual pivot drop thigh mount assembly to the user in a desired configuration. In alternate embodiments, the dual pivot drop thigh mount assembly can also be worn on another part of a user's person, or the dual pivot drop thigh mount assembly can be used to support an implement or implement holster in another location, not on a user.

Techniques and devices are discussed with reference to example handgun holsters, magazines, and accessories. However, this is not intended to be limiting, and is for ease of discussion and illustrative convenience. The dual pivot drop thigh mount assembly is designed and constructed to accommodate a multitude of support applications. For instance, the techniques and devices discussed may be applied to any of various implements, weapons, tools, instruments, accessories, supplies, cases, case designs, containers, canisters, combinations, and the like, and remain within the scope of the disclosure.

Implementations are explained in more detail below using a plurality of examples. Although various implementations and examples are discussed here and below, further implementations and examples may be possible by combining the features and elements of individual implementations and examples.

Example Drop Thigh Mount Assembly

An example dual pivot drop thigh mount assembly ("assembly") 100, as shown in FIGS. 1-7, is disclosed herein and described in several non-limiting example configurations. In various embodiments, an example assembly 100, as shown in FIGS. 1-7, allows for a carrier (such as an implement or an implement holster, for example) and/or one or more accessories (such as a mag carrier, flashlight, tourniquet, etc.) to be mounted to a user or a user's article of clothing (such as a belt), a user accessory, or other surface using a subset of a receiver 102, an adapter 104, a belt slide 106 a drop thigh plate 108, and a drop bar 110. In some embodiments, an assembly 100 also includes means of attaching the drop thigh plate 108 to the user, such as with one or more leg straps 402. In other embodiments, other attachment means may be used to hold the assembly 100 in a desired location. In alternate embodiments, the assembly 100 may include additional or alternate components or features.

Figure 2:
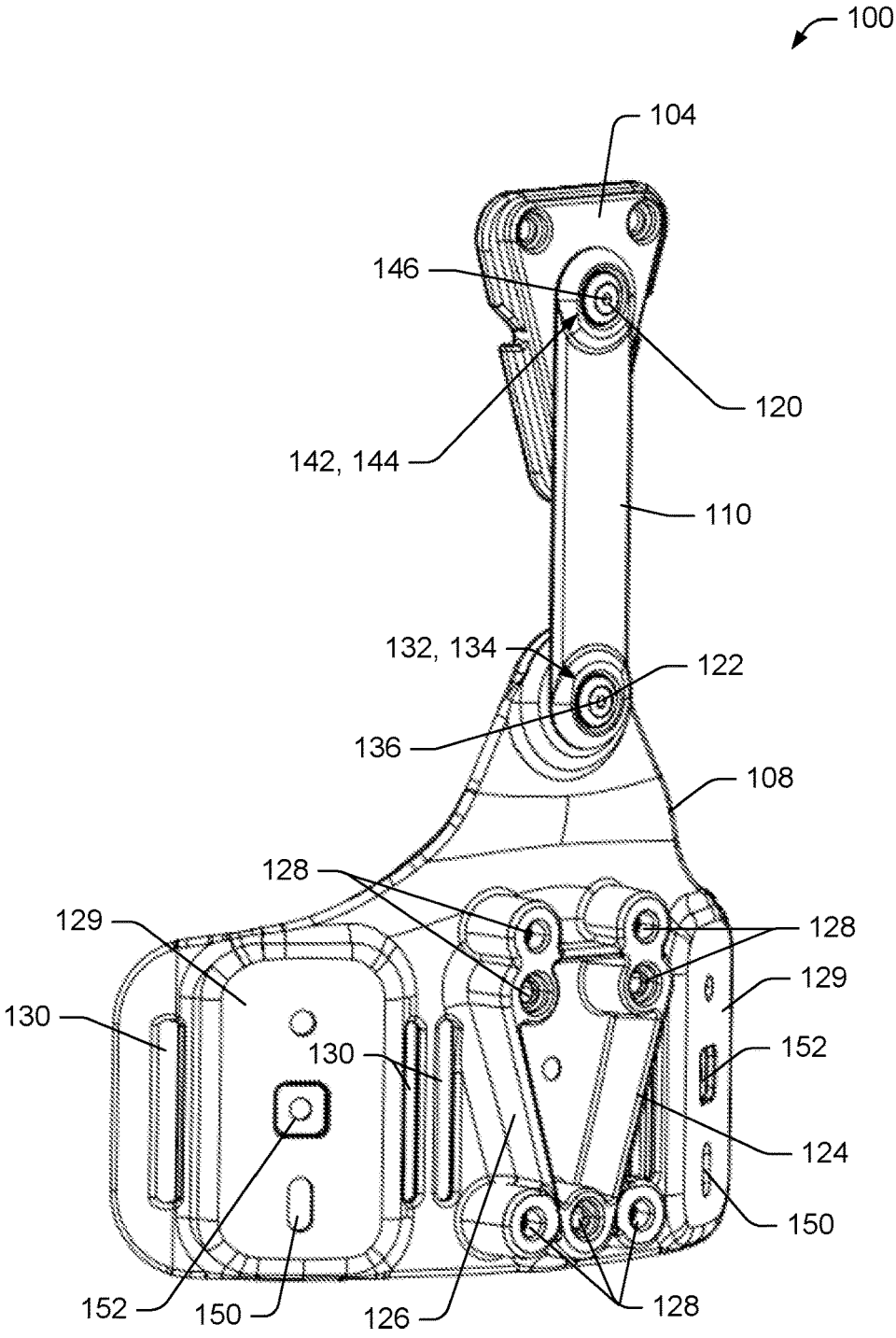
FIG. 2 shows a perspective view of an example dual pivot drop thigh mount assembly, according to another embodiment.
Figure 3:
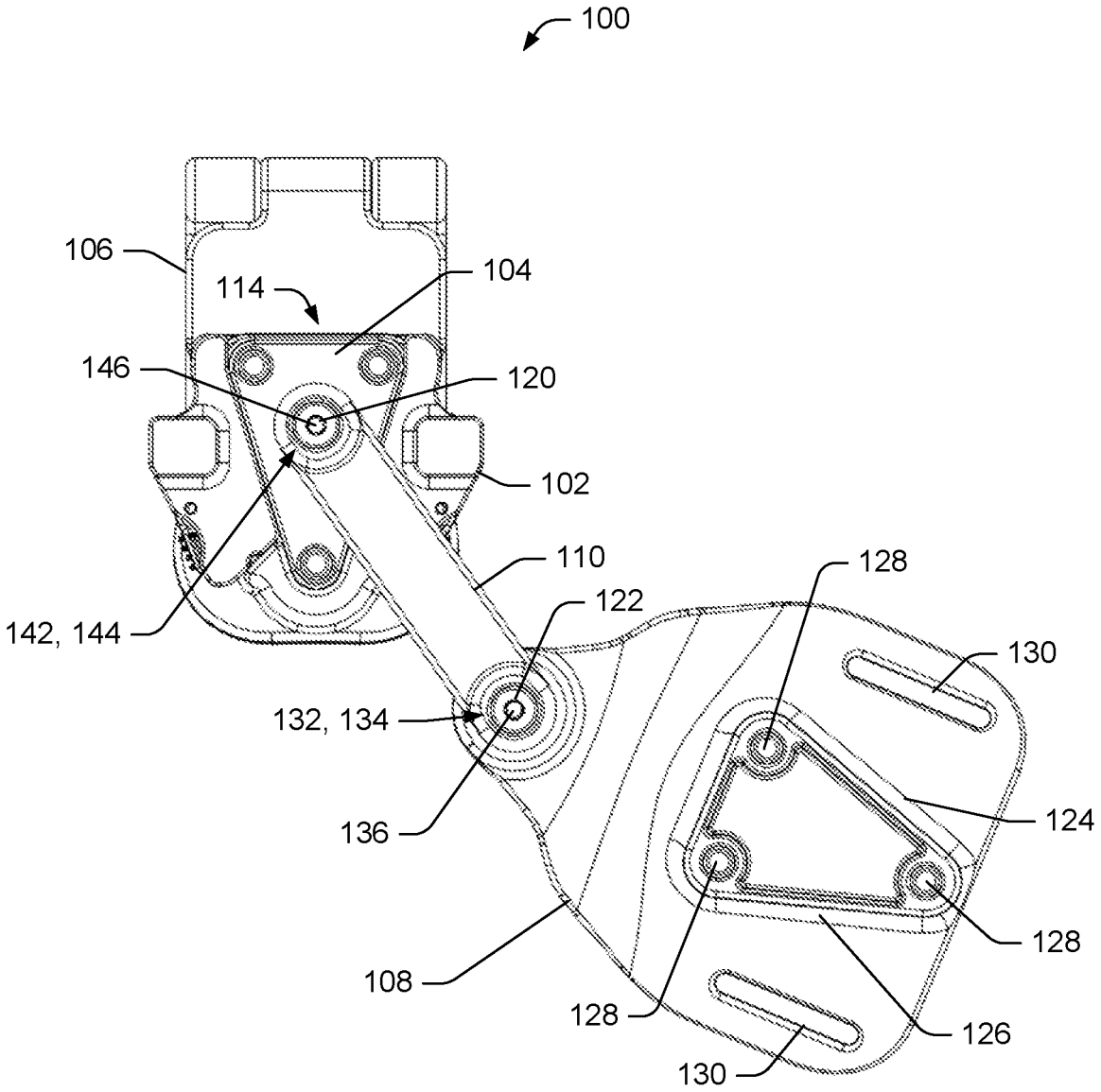
FIG. 3 shows a front view of an example dual pivot drop thigh mount assembly, illustrated to show two pivot points, according to an embodiment.
Figure 4:
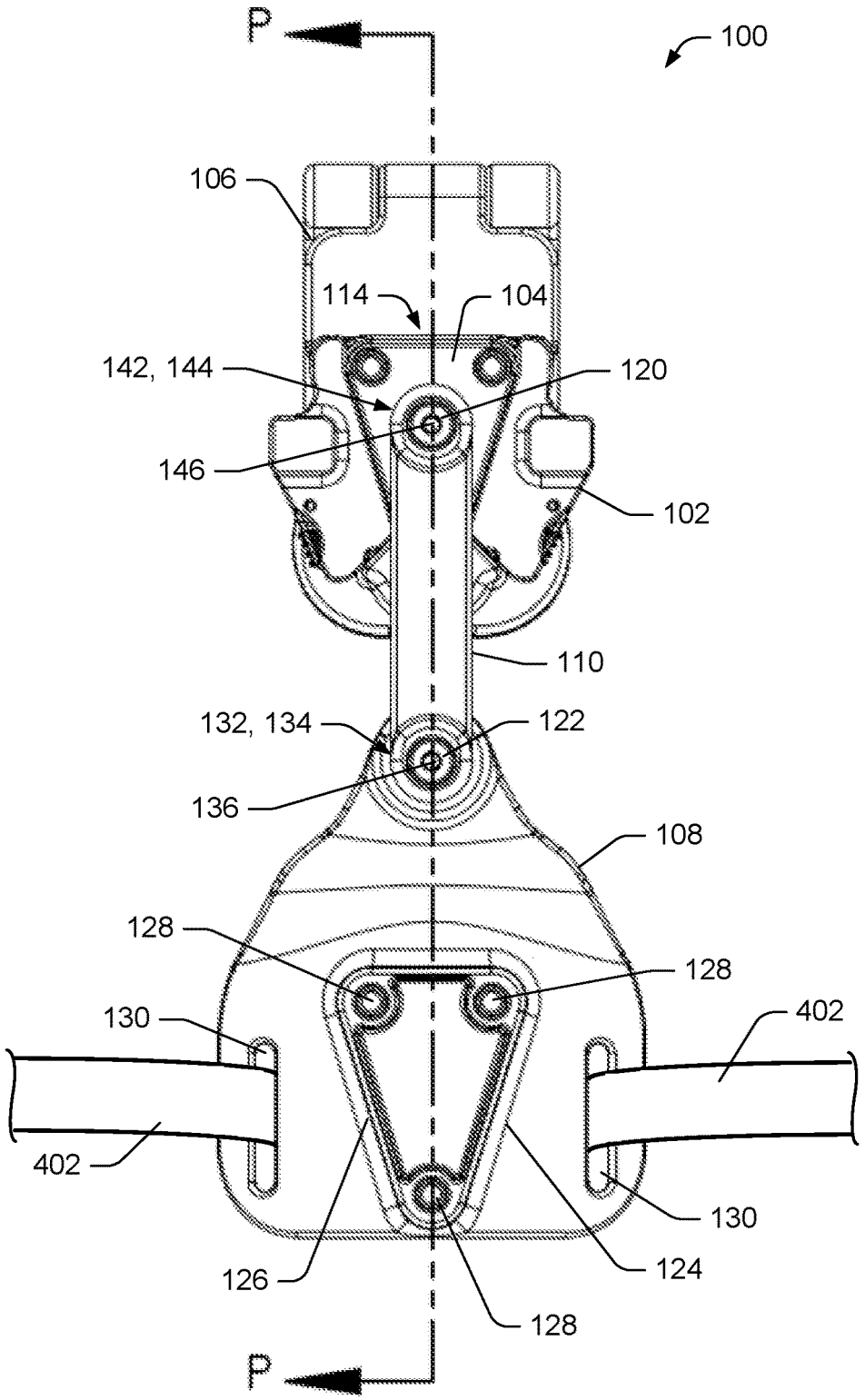
FIG. 4 shows a front view of an example dual pivot drop thigh mount assembly, according to an embodiment.
Figure 5:
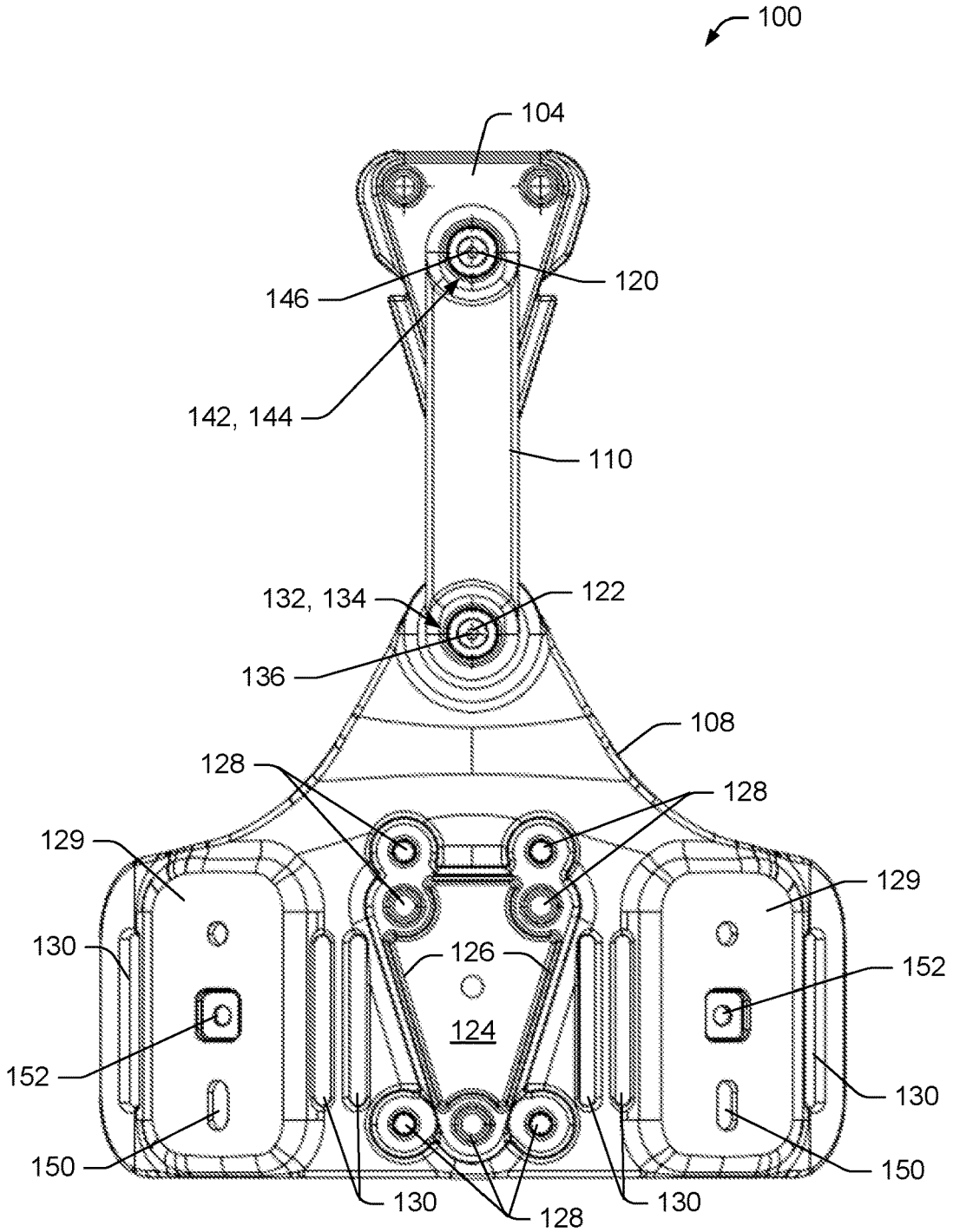
FIG. 5 shows a front view of an example dual pivot drop thigh mount assembly, according to another embodiment.
Figure 6:
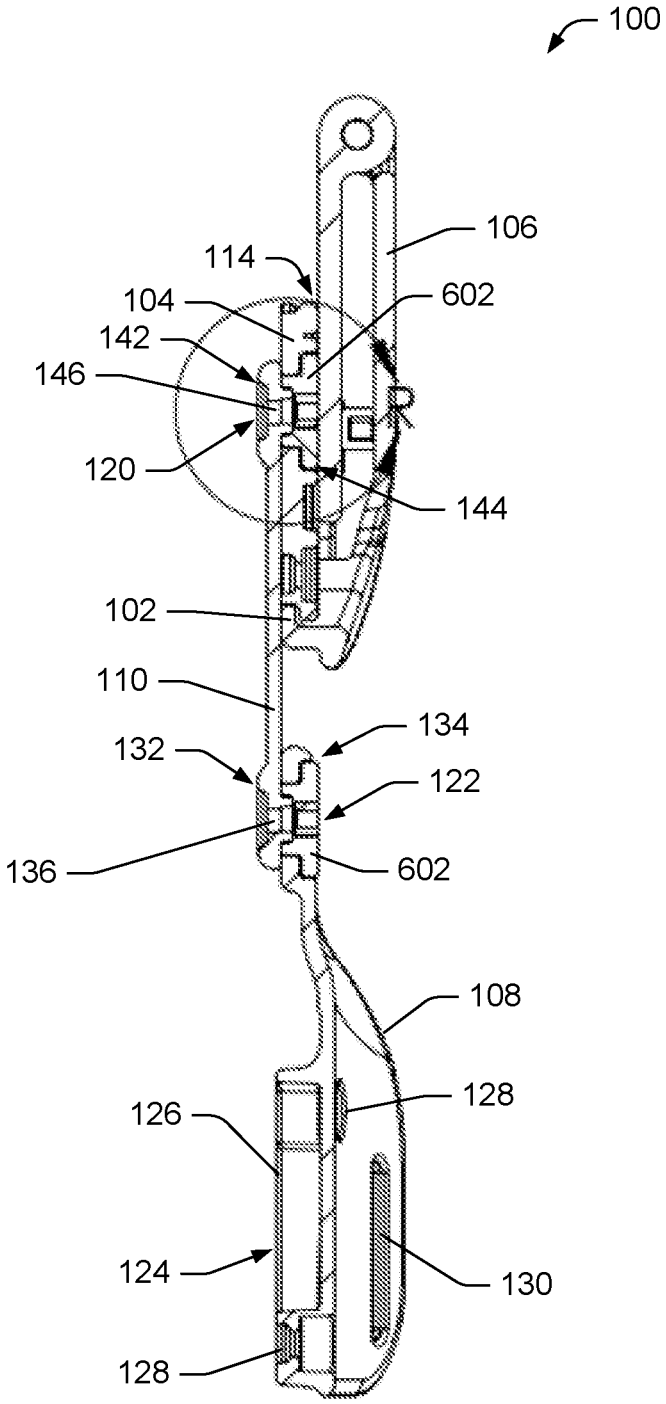
FIG. 6 shows a side cross-section view of an example dual pivot drop thigh mount assembly, according to an embodiment.
Figure 7:
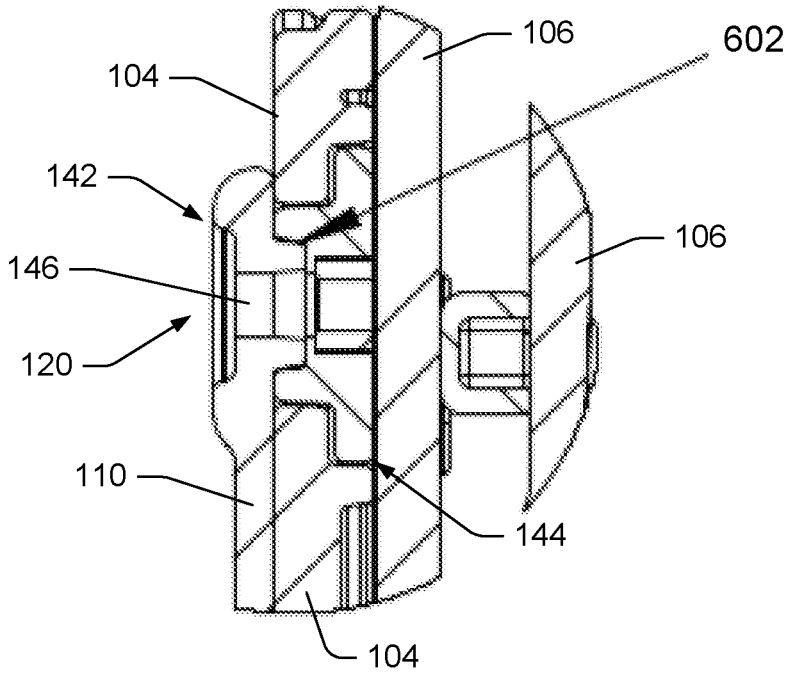
FIG. 7 shows a side cross-section view at close detail of the upper pivot point of an example dual pivot drop thigh mount assembly, according to an embodiment.

Referring to FIGS. 1-7, various views of an example assembly 100 are shown. FIGS. 1, 2, 4, 5, and 6 show an example assembly 100 in a plumb orientation, with little or no pivot at either of the upper 120 or lower 122 pivot points. FIG. 3 shows an example assembly 100 in a pivoted orientation, illustrating some degree of pivot at both of the upper 120 and lower 122 pivot points. It should be noted that the upper 120 and lower 122 pivot points can pivot independently from each other. FIG. 6 shows a cross-section side view of an example assembly 100, as cut at the line P-P of FIG. 4. FIG. 7 shows a detail view of the cross-section side view of FIG. 6, as indicated by the circle marked "R."

In various embodiments, an assembly 100 includes at least a drop thigh plate 108, a drop bar 110, and a mount plate or adapter 104. The drop thigh plate 108 is a rigid surface for mounting an implement, an implement holster, one or more accessories, and the like. The drop thigh plate 108 is designed and intended for supporting one or more heavy objects to be worn on a user's person, generally on the user's upper leg or thigh. The drop bar 110 is a rigid member (or combination of rigid members coupled together) that extends the mounting point for the drop thigh plate 108 a predetermined distance, while maintaining a secure connection to the drop thigh plate 108. The drop bar 110 has a pivot point at each end to allow movement of the drop bar 110 relative to the adapter 104 and to allow movement of the drop thigh plate 108 relative to the drop bar 110. The mount plate or adapter 104 comprises a connection component for the drop bar 110 to a mounting point on the user. For example, the adapter 104 can be temporarily attached to a belt slide, such as the belt slide 106 shown at FIG. 1, for example, worn on the user's belt or clothing, or some other article or accessory worn by the user. The combination of the drop thigh plate 108, the drop bar 110, and the adapter 104 allow a holster and/or other accessories to be worn in a dropped configuration on a user's thigh, rather than at the waist, for example. In some embodiments, the assembly 100 can include additional or alternate components.

As shown at FIGS. 1-6, the drop thigh plate 108 comprises a rigid curved plate, where the curvature of the plate is intended to conform to the general shape of a user's upper leg (or thigh). For instance, the overall shape of the drop thigh plate 108 may resemble a portion of the side of a cylinder. In other words, the drop thigh plate 108 has an overall curved shape so as to be comfortably worn on a user's upper leg. Alternately, to effect the curvature, the shape of the drop thigh plate 108 may resemble a portion of a side of a many-sided prism. For instance, the curvature of the drop thigh plate 108 may be approximated by a plurality of substantially planar sections. When worn on the outside of the user's thigh, the curved shape of the drop thigh plate 108 wraps partly around the user's thigh. As explained above, the drop thigh plate 108 can also be worn in another location on the user's person, or attached to a location not on the user.

The drop thigh plate 108 of the assembly 100 provides a rigid surface to attach one or more objects, including substantially heavy objects such as a handgun and holster and/or heavy accessories. For instance, as shown at FIGS. 1-5, the drop thigh plate 108 includes an attachment base 124 for a handgun holster or other implement or implement holster or accessory to be mounted. The attachment base 124 can be integrated or coupled to the drop thigh plate 108 to accommodate mounting a holster and/or one or more accessories. The attachment base 124 may be a specific mount for a particular carrier (e.g., holster, sheath, container, etc.) design, in shape, configuration, number and location of mounting points, and the like, or it may be generic to accommodate various carriers or accessories. The attachment base 124 may be disposed at a convenient location on the drop thigh plate 108 for ease of access by the user and for weight distribution on the wearer.

The attachment base 124 comprises a mount fixture integral to or coupled to the drop thigh plate 108. In various embodiments, more than one attachment base 124 can be disposed on the drop thigh plate 108. If more than one attachment base 124 is disposed on the drop thigh plate 108, each attachment base 124 need not be identical, and may be shaped and sized for different applications. As shown at FIGS. 1-5, the attachment base 124 may include a raised rim or ledge 126 defining at least a portion of a perimeter or shape of the attachment base 124. The raised ledge 126 can provide a structural mounting location for a holster, accessory, or other carrier as desired.

In an embodiment, the attachment base 124 includes one or more holster mounting attachment points 128, such as the holster mounting points 128 as shown in the figures, for receiving fasteners used to couple items to the attachment base 124. Mounting points 128 can be used to attach an implement holster (such as a handgun holster, shell, or the like), or other carrier, sheath, case, etc., or an adapter (for instance, a quick release adapter) that can be coupled to the implement, the holster or shell, or the like. Mounting points 128 can comprise unthreaded openings, threaded or tapped openings, openings with inserts, and the like. For example, some mounting points 128 may be tapped/threaded to receive screws or bolts or they may not be tapped/threaded so as to accommodate a variety of fasteners. Some mounting points 128 may be disposed adjacent to or integral with the raised ledge 126, which can provide structural strength to support heavy objects attached to the attachment base 124. Some mounting points 128 may also be isolated from the raised ledge 126.

Referring to FIGS. 2 and 5, additionally or alternately, the drop thigh plate 108 may include accessory mount pads 129 (or other adapter mounts or attachment points or types) for mounting accessories or less lethal tools (e.g., mag carriers, flashlights, tourniquets, pepper spray, Taser, stun gun, etc.), or the like to the drop thigh plate 108. Accessory mount pads 129 can be coupled to or integral with the drop thigh plate 108, and located or disposed at one or more locations on the drop thigh plate 108 as convenient to the user. As shown at FIGS. 2 and 5, the drop thigh plate 108 may have a larger or extended surface area as needed to accommodate multiple accessory mount pads 129. In various embodiments, the accessory mount pads 129 can include one or more features 150 arranged and configured for mounting generic or specific accessories to the accessory mount pads 129. For example, the one or more features 150 can be helpful to align, center, mount, or otherwise fix the accessories to the accessory mount pads 129. Additionally, the accessory mount pads 129 can have one or more accessory mount fixtures or holes 152 to secure the accessories mounted thereon with threaded or non-threaded fasteners, and the like.

In various embodiments, the mounting points 128, accessory mount pads 129, and accessory mount fixtures 152 (and the raised ledge 126) may be sized and spaced to accommodate a specific implement holster, accessory, or adapter. For instance, the triangular shape of the raised ledge 126 and the spacing of the mounting points 128 shown at FIGS. 1-5 can be intended to receive a particular holster, carrier, or adapter. Alternately, the mounting points 128 (and the raised ledge 126) may be sized and spaced to be generally disposed to accept a number of different holsters, backers, adapters, cases, etc. The mounting points 128 and/or accessory mount fixtures 152 may be tapped/threaded to receive screws or bolts or the mounting points 128 and/or accessory mount fixtures 152 may not be tapped/threaded so as to accommodate a variety of fasteners. In an alternate embodiment, the mounting points 128 and/or accessory mount fixtures 152 may include attachment connectors or hardware for coupling generic carriers or a specific holster, backer, or adapter.

As shown at FIGS. 1-6, the drop thigh plate 108 can also include one or more strap openings 130. The strap openings 130 may comprise oblong slots, holes, or the like, configured to receive straps 402 through the openings 130. In alternate embodiments, the strap openings 130 may include strap connectors or the like (not shown), rather than strictly openings or holes.

Further, the strap openings 130 may include gripping features, such as teeth or ridges, or a gasket to help hold straps 402 in place. In other embodiments, the drop thigh plate 108 may include additional strap openings 130, additional to the strap openings 130 shown in the figures. Alternately, the arrangement or orientation of the strap openings 130 may be different than shown in the drawings.

Straps 402 may be threaded into the strap openings 130 and may include one or more strap connectors arranged to couple the straps 402 to the drop thigh plate 108 or to couple straps 402 to themselves or other straps. In various implementations, the straps 402 and/or drop thigh plate 108 may include additional or alternate components for coupling the straps 402 to the drop thigh plate 108.

In an example, one or more straps 402 can be wrapped around the upper leg of the user and threaded through the strap openings 130 of the drop thigh plate 108 to secure the drop thigh plate 108 to the thigh of the user. A single strap 402 may be wrapped around the upper leg of the user and threaded through the strap openings 130 in the drop thigh plate 108. Alternately, two or more straps 402 can be wrapped around the upper leg of the user and threaded through one or more sets of strap openings 130 in the drop thigh plate 108. Strap couplers (not shown, e.g., hook and loop materials, clamps, buckles, clips, snaps, etc.) may be used to secure the straps 402 in place.

In an implementation, a strap 402 can include an adjustment portion (not shown) coupled to one end of the strap 402 to provide retention of the strap 402 to the user. In the implementation, the adjustment portion can interface with a fastener of a closure portion at another end of the strap 402. The adjustment portion and the closure portion can temporarily couple together the ends of the strap 402 when the strap 402 is wrapped around the user. In one example, the adjustment portion comprises hook and loop fasteners, or the like. In the example, the adjustment portion may be inserted through an opening 130, and looped back on itself or on the strap 402, temporarily coupling the adjustment portion to the other end of the strap 402.

Referring to FIGS. 1-6, the drop thigh plate 108 is pivotally coupled to the drop bar 110. The drop bar 110 comprises a rigid member that is coupled to the drop thigh plate 108 (at an upper location on the drop thigh plate 108, in one example) at a lower pivot point 122 on the drop bar 110. The lower pivot point 122 can allow the drop thigh plate 108 to pivot freely in any direction relative to the drop bar 110. Alternately, some pivoting may be limited if desired, for instance to a predetermined angle or extent.

Generally, the lower pivot point 122 is defined by a pair of openings 132, 134 in the drop bar 110 and the drop thigh plate 108, respectively, with a hinge pin 136 passing through both openings 132 and 134. The hinge pin 136 can also couple the drop bar 110 and the drop thigh plate 108 together, and may be removable by the user for disassembly. Additional components may be included, such as a rotation cap 602 (see FIGS. 6 and 7, for example), bearing components, or the like, that encourage freedom of rotational movement at the pivot point 122 while keeping the drop bar 110 coupled to the drop thigh plate 108.

In various embodiments, the upper 120 and lower 122 pivot points are free to pivot without restraint. In some cases, bearings, rotation caps, or the like may be used at a pivot point 120, 122 to promote freedom of movement. In alternative embodiments, one or both of the upper 120 and lower 122 pivot points may be restrained by one or more materials or mechanisms within the pivot point 120, 122 (e.g., on one or both facing surfaces) that is intended to limit the ability of the pivot point 120, 122 to pivot, such as friction enhancing surfaces, contoured surfaces, or the like.

In various embodiments, the drop bar 110 may comprise a single rigid member or multiple rigid sections coupled together to form the drop bar 110. For example, two or more rigid sections (not shown) may be coupled together in a manner to allow the length of the drop bar 110 to be adjusted, and to lock the drop bar 110 at the desired length. Further, in some cases the two or more rigid sections may be adjustable to allow the drop bar 110 to be substantially straight or to have an adjustable angle along a length of the drop bar 110. To allow for these adjustments, the rigid sections may be provided with multiple coupling locations, a sliding coupling arrangement, or the like. In an embodiment, multiple drop bars 110 (with different lengths and/or angles) may be supplied with a dual pivot drop thigh mount assembly 100 (or a choice of multiple drop bars 110), so that a user can select the drop bar 110 style and length desired, for a custom fit.

The mount plate or adapter 104 is pivotally coupled to the drop bar 110 at the opposite end of the drop bar 110 at an upper pivot point 120. The upper pivot point 120 can allow the drop bar 110 to pivot freely in any direction relative to the adapter 104 (or with some limitations in some embodiments). Generally, the upper pivot point 120 is defined by openings 142, 144 in the drop bar 110 and the adapter 104, respectively, with a hinge pin 146 passing through both openings 142 and 144. The hinge pin 146 can also couple the drop bar 110 and the adapter 104 together, and may be removable by the user for disassembly. Additional components may be included, such as a rotation cap 602 (see FIGS. 6 and 7, for example), bearing components, or the like, that encourage freedom of rotational movement at the pivot point 120 while keeping the drop bar 110 coupled to the adapter 104.

The mount plate or adapter 104 comprises a rigid component adapted to mate with a receiving component worn on the user's person (or located elsewhere). The adapter 104 can be configured to be removable from the receiving component by the user as desired. The adapter 104 may be specific in size and shape, etc. so as to interface with a particular user-worn component (such as a belt slide or the like) or it may be generic to allow the adapter 104 to couple to several types of user-worn articles or components.

In some cases, as shown in the figures, the adapter 104 can have a shape and size that would fit on the attachment base 124 of the drop thigh plate 108. In other words, the adapter 104 can be a shape and size that is a substitute for a mounting component on a holster, so that the holster can be mounted on the attachment base 124 of the drop thigh plate 108 (at a lower location on the user) and the adapter 104 can be mounted to a belt (for example) of the user in its place (at the higher location on the user). In an alternate embodiment, the adapter 104 is configured to be worn on the user itself. For instance, the adapter 104 may comprise a paddle, a belt slide or clip, or the like.

In an embodiment, the adapter 104 is configured to be coupled to a receiver 102 on a user-worn component. For instance, the adapter 104 can be configured to couple to a receiver 102, such as the receiver 102 described in U.S. Pat. No. 11,047,644B2, which is incorporated by reference in its entirety, or a similar receiver. As such, the receiver 102 can be worn by the user and the adapter 104 may be locked to the receiver 102 until intentionally released by the user. For example, the receiver 102 may include one or more locking mechanisms configured to lock the adapter 104 to the receiver 102.

In some embodiments, as shown at FIGS. 1, 3, 4, and 6, the dual pivot drop thigh mount assembly 100 includes a belt slide 106 with an integral or coupled receiver 102. In some further embodiments, the belt slide 106 is a hinged locking belt slide 106 as described in U.S. patent application Ser. No. 18/481,397, which is also incorporated by reference in its entirety. In various implementations, the receiver 102 is integral with or fixed to the belt slide 106, such as the 2-piece (or more) hinged belt slide 106 illustrated in FIG. 1. As shown at FIGS. 1, 3, 4, and 6, the hinged locking belt slide 106 may include a receiver pocket 114 configured to receive the adapter 104. The locking belt slide 106 can be locked into a closed configuration by inserting the adapter 104 into the receiver pocket 114 and can be opened after removing the adapter 104 from the receiver pocket 114.

The drop thigh plate 108, drop bar 110, and/or adapter 104 may be comprised of injection molded polymers, such as Nylon, other thermoplastics, and the like. Three-dimensional printing may also be used to form the components using a suitable polymer, or polymer/fiber composite. A single layer or multiple layers of materials may be used to form the drop thigh plate 108, drop bar 110, and/or adapter 104. Alternate materials (which may be used alone or in combination with polymers and/or each other) may include fiberglass, carbon fiber, other composites, metals, alloys, and so forth. For example, some materials that may be used include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, various metals and alloys, fiber composites, combinations of the same, and the like. Materials may be selected for desired strength combined with light weight. In some embodiments, the drop thigh plate 108, drop bar 110, and/or adapter 104 are comprised of laminated layers of different materials, which may include combinations of any of the materials listed above. In other embodiments, a portion may be comprised of multiple laminated layers.

Flexible components (such as straps 402) may be comprised of flexible polymers, TPEs, aramids, ballistic materials, natural or synthetic leathers, other textiles, or the like. In some embodiments, the straps 402 may be comprised of a single layer or multiple layers of materials. The multiple layers may be selected to provide various desired characteristics for the straps 402 such as strength, comfort, resilience, utility, weight, and so forth. In many examples, all layers may contribute to desired light weight, strength, and resilience. In some implementations, the straps 402 include one or more reinforcement layers comprising a metal, a metal alloy, a metallic composite, other composite(s), ballistic nylon, or the like.

The assembly 100 is discussed in terms of securing a holster and various accessories, but the assembly 100 may be used to secure or mount any of various items, where secure mounting is desired. Although various implementations and examples are discussed herein, further implementations and examples may be possible by combining the features and elements of individual implementations and examples.

In various implementations, the assembly 100 may include fewer, more, or alternate components, or have different shapes or sizes than those illustrated and remain within the scope of the disclosure. In various embodiments, the shape and configuration of the assembly 100 components may vary to accommodate different implements or applications. In an example, the attachment base 124, accessory mount pads 129, and/or the adapter 104 may be formed to closely fit a particular implement holster, case, or rig. In other examples, the attachment base 124, accessory mount pads 129, and/or the adapter 104 may be more generally formed to fit multiple implement applications.

The illustrations of FIGS. 1-7 are not intended to be limiting. In the various example embodiments illustrated in FIGS. 1-7, the location and position of the components, mechanisms, and the like are for example only. Other locations and positions are contemplated and are within the scope of this disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that an assembly 100 may be implemented as a stand-alone device or as part of another system (e.g., integrated with other components, such as a duty belt).

Various implementations and examples are discussed herein, and further implementations and examples may be possible by combining the features and elements of individual implementations and examples.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. A holster mounting assembly, comprising:

a drop thigh plate adapted to be coupled to an implement holster, the drop thigh plate comprising a rigid curved plate configured to substantially conform to a contour of a human thigh and including an attachment base with one or more holster mounting attachment points;

a drop bar pivotally coupled at one end of the drop bar to an upper portion of the drop thigh plate; and a mount plate pivotally coupled to a second end of the drop bar, wherein the mount plate is adapted to couple the drop thigh plate and drop bar to an article worn by a user.

2. The holster mounting assembly of claim 1, further comprising one or more straps coupled to the drop thigh plate via one or more strap holes to secure the drop thigh plate to a leg of the user.

3. The holster mounting assembly of claim 1, further comprising one or more accessory mount pads coupled to or integral with the drop thigh plate.

4. The holster mounting assembly of claim 1, further comprising a receiver configured to receive the mount plate, the receiver adapted to couple the mount plate to the article worn by the user.

5. The holster mounting assembly of claim 4, further comprising a belt slide integral to or coupled to the receiver.

6. A mounting assembly, comprising:

a rigid curved plate configured to substantially conform to a contour of a human thigh, including:

an attachment base comprising a mount fixture integral to or coupled to a surface of the curved plate;

one or more mounting attachment points at the attachment base;

one or more strap slots at the surface of the curved plate, arranged to receive a strap; and a first pivot point on the surface of the curved plate;

a rigid drop bar pivotally coupled at a first end of the drop bar to the first pivot point of the curved plate; and an adapter pivotally coupled at a second pivot point on the adapter to a second end of the drop bar, the adapter configured to couple the drop bar to a support component worn by a user.

7. The mounting assembly of claim 6, further comprising a belt slide having a receiver, wherein the adapter is configured to mount to the receiver of the belt slide.

8. The mounting assembly of claim 6, further comprising one or more additional mount pads with mount fixtures integral to or coupled to the surface of the curved plate.

9. The mounting assembly of claim 6, wherein the curved plate is shaped as a curved portion of a side of a cylinder.

10. The mounting assembly of claim 6, wherein the attachment base includes a raised rim or ledge defining at least a portion of a perimeter of the attachment base.

11. The mounting assembly of claim 10, wherein the raised rim or ledge comprises a structural mounting location for a holster or accessory.

12. The mounting assembly of claim 6, wherein at least one of the one or more mounting attachment points is tapped to receive a threaded fastener.

13. The mounting assembly of claim 6, wherein the one or more slots comprise oblong openings through the curved plate.

14. The mounting assembly of claim 6, wherein the curved plate is arranged to be strapped to a user's thigh using one or more straps threaded through the one or more strap slots.

15. The mounting assembly of claim 6, wherein the adapter has a same perimeter shape as a perimeter of the attachment base.

16. The mounting assembly of claim 6, wherein the support component comprises a belt slide configured to be worn on a user's belt.

17. The mounting assembly of claim 6, wherein the first and second pivot points are configured to pivot independently of each other.

18. A holster mounting assembly, comprising:

a drop thigh plate adapted to be coupled to an implement holster, the drop thigh plate comprising a rigid curved plate configured to substantially conform to a contour of a human thigh and including:

an attachment base with holster mounting attachment points;

one or more strap slots arranged to receive a strap; and a pivot point on a surface of the curved plate;

a drop bar pivotally coupled at one end of the drop bar to the pivot point of the drop thigh plate;

an adapter pivotally coupled to a second end of the drop bar; and a receiver configured to removably secure the adapter, and to thereby couple the drop thigh plate and drop bar to a holster support component worn by a user.

19. The holster mounting assembly of claim 18, further comprising one or more accessory mount pads.

20. The holster mounting assembly of claim 18, wherein the implement comprises a firearm.

* * * * *